US007504578B2

(12) United States Patent
Lewry

(10) Patent No.: US 7,504,578 B2
(45) Date of Patent: Mar. 17, 2009

(54) SYSTEM AND METHOD FOR PROVIDING A MUSICAL INSTRUMENT HAVING A MONITOR THEREIN

(76) Inventor: Benjamin T. Lewry, 70 Park Ave., Manchester, NH (US) 03104

( * ) Notice: Subject to any disclaimer, the term of this patent is extended or adjusted under 35 U.S.C. 154(b) by 0 days.

(21) Appl. No.: 11/927,086

(22) Filed: Oct. 29, 2007

(65) Prior Publication Data

US 2008/0098877 A1 May 1, 2008

Related U.S. Application Data

(60) Provisional application No. 60/855,345, filed on Oct. 30, 2006.

(51) Int. Cl.
*G10H 1/32* (2006.01)
*G10H 3/00* (2006.01)
*G10D 3/00* (2006.01)

(52) U.S. Cl. ..... 84/743; 84/290

(58) Field of Classification Search ..... 84/724, 84/730, 731, 600, 743, 290, 291
See application file for complete search history.

(56) References Cited

U.S. PATENT DOCUMENTS

| | | | | |
|---|---|---|---|---|
| 2,737,842 | A | | 3/1956 | Polfuss |
| 2,972,923 | A | | 2/1961 | Fender |
| 3,324,755 | A | | 6/1967 | Canonico |
| 3,580,126 | A | | 5/1971 | Forkner |
| 3,958,113 | A | | 5/1976 | Termohlen |
| 4,069,733 | A | | 1/1978 | Quan |
| 4,236,191 | A | | 11/1980 | Martinez |
| 4,314,495 | A | | 2/1982 | Baggs |
| 4,357,852 | A | | 11/1982 | Suenaga |
| 4,563,933 | A | | 1/1986 | Kim |
| 4,688,460 | A | | 8/1987 | McCoy |
| 4,704,941 | A | | 11/1987 | Reilly |
| 4,745,837 | A | | 5/1988 | Rimsa |
| 4,774,867 | A | | 10/1988 | Fishman |
| 4,775,765 | A | | 10/1988 | Kimura et al. |
| 5,025,703 | A | * | 6/1991 | Iba et al. ..... 84/718 |
| 5,027,112 | A | | 6/1991 | Ross et al. |
| 5,121,669 | A | * | 6/1992 | Iba et al. ..... 84/735 |
| 5,198,803 | A | | 3/1993 | Shie et al. |
| 5,241,308 | A | | 8/1993 | Young |
| 5,286,908 | A | | 2/1994 | Jungleib |
| 5,308,916 | A | * | 5/1994 | Murata et al. ..... 84/603 |
| 5,442,986 | A | * | 8/1995 | Cota ..... 84/267 |
| 5,508,470 | A | | 4/1996 | Tajima et al. |
| 5,796,025 | A | | 8/1998 | Haake |

(Continued)

*Primary Examiner*—Jeffrey Donels
(74) *Attorney, Agent, or Firm*—Peter A. Nieves; Sheehan Phinney Bass + Green, P.A.

(57) ABSTRACT

A musical instrument, having a monitor therein, contains a musical instrument body having a body cavity therein, and the monitor having a front face and a back, where the monitor fits within the body cavity of the musical instrument body. A screen cover is situated above the front face of the monitor and a cover plate positions the screen cover above the front face of the monitor, where the cover plate covers at least a portion of the screen cover. A bridge is located on a front face of the screen cover, where the bridge contains a pickup that does not use electromagnetic induction, and that senses vibrations of strings, suspended on said bridge, above the monitor, and translates the vibrations into audio signals.

25 Claims, 5 Drawing Sheets

U.S. PATENT DOCUMENTS 5,837,912 A * 11/1998 Eagen ..... 84/267
6,191,348 B1 * 2/2001 Johnson ..... 84/485 R
6,191,350 B1 * 2/2001 Okulov et al. ..... 84/646
6,291,755 B1 * 9/2001 Hine et al. ..... 84/454
6,653,543 B2 * 11/2003 Kulas ..... 84/454
6,787,690 B1 * 9/2004 Celi et al. ..... 84/723
7,166,794 B2 1/2007 Juszkiewicz et al.
7,173,175 B2 2/2007 Shaffer
7,220,912 B2 * 5/2007 Juszkiewicz et al. ..... 84/742
7,355,110 B2 * 4/2008 Nash ..... 84/601
2003/0169377 A1 * 9/2003 Kulas ..... 349/1
2005/0172785 A1 8/2005 Fisher-Robbins et al.
2005/0252359 A1 11/2005 Cook

* cited by examiner

SYSTEM AND METHOD FOR PROVIDING A MUSICAL INSTRUMENT HAVING A MONITOR THEREIN

CROSS-REFERENCE TO RELATED APPLICATION

This application claims priority to copending U.S. Provisional Application entitled, "An Instrument Having A Monitor Therein," having Ser. No. 60/855,345, filed Oct. 30, 2006, which is entirely incorporated herein by reference.

FIELD OF THE INVENTION

The present invention is generally related to musical instruments, and more particularly is related to a musical instrument having a monitor therein.

BACKGROUND OF THE INVENTION

Stringed instruments commonly use a bridge to suspend strings over the front of the instrument body. The function of the bridge is to support the strings, in the proper playing position, over the top (front facing portion) of a stringed instrument body. The bridge works in cooperation with a nut. The bridge and nut each stabilize an opposite side of the vibrating portion of the string, allowing the string to vibrate between them. The bridge commonly functions to set the intonation of the instrument and to control the height of the strings above the fingerboard.

Traditionally the bridge of an acoustic stringed instrument transmits string vibrations to a sound board to vibrate the top of the instrument. Typical electronic stringed instruments use the bridge to hold the string in playing position above an electronic pickup. Common electronic stringed instruments use an electromagnetic type pickup to sense vibrations from the strings. The electromagnetic pickups are located between the neck and the bridge, and are often recessed into the body of the instrument beneath the vibrating portion of the string. The signal from the magnetic pickup is sent to an amplifier and then to a speaker where it is converted to audio, which one can listen to.

The bridge for a solid body electric type stringed instrument is generally mounted directly to the instrument body. A sturdy mounting system is critical in order to produce a durable instrument with a bright tone. Typically the bridge is mounted on posts, anchors, or screws, which are sunk securely into the instrument body. This "direct to body" mounting system limits the design of an instrument containing a monitor. Typical matrix type display monitors cannot be drilled or cut in the center of the monitor without damage or a loss of function. Therefore, presently available monitor instrument designs show that the monitor has been located next to, but not beneath, the mounting posts of the bridge.

Electro-magnetic pickups pose an additional problem when used in combination with a monitor. Electro-magnetic pickups function optimally when in close proximity to a vibrating string. They are typically mounted in the instrument body between the bridge and the neck, and are commonly positioned less than one inch beneath the strings. Electro-magnetic pickups are subject to electrical interference when placed in close proximity to a display monitor. This interference creates an unpleasant "hum" type noise when the instrument is amplified, rendering the instrument useless for performance.

Electro-magnetic pickups are presently used in examples of present instruments containing monitors, an example of which is shown by U.S. Pat. No. 4,745,837 to Rimsa. This type of pickup senses distortions in a magnetic field around a coil of wire. Current inside the coil is altered by the vibration of a ferro-magnetic string, and an electrical signal is induced. This signal is then sent to an amplifier and speaker for amplification. Electro-magnetic pickups are difficult to use alongside a monitor because the magnetic pickup is subject to electronic interference emitted by the monitor. It sends this unwanted interference to the output of the guitar for amplification. This situation creates a noisy and unpleasant "humming" sound from the instrument.

Additionally, electromagnetic pickups occupy space in the body between the bridge and the neck of the instrument. This limits the possible locations where a monitor could be mounted on the instrument because the pickups physically conflict with the monitor for space on the front of the body. Also, if the magnetic pickups were to be mounted above the monitor, they would impede the aesthetic quality of the monitor by blocking the view of the image on the screen.

Therefore, existing instruments do not have a monitor mounted in the same location as the electromagnetic pickups. Instead, the prior art reveals a monitor mounted far away from the pickups of the instrument. This was done to avoid physical conflicts with the pickup and bridge mountings, and to avoid electrical interference with the magnetic pickups. This prior art design greatly limits the size and placement of the monitor which can be mounted in the instrument.

For exemplary purposes, FIG. 1 is a schematic diagram illustrating a cross-sectional side view of a prior art stringed instrument containing a monitor. This illustration clearly shows the monitor 118 being located next to the bridge 121, but not beneath it. The bridge 121 is mounted with stud type anchors 120 that mount into the body 111. These anchors 120 physically prevent the monitor 118 from occupying the space beneath the bridge 121. For this reason, the monitor 118 is forced to be much smaller and it cannot be located central to the body of the instrument.

Additionally, FIG. 1 shows two electromagnetic type pickups 119 mounted in the body area between the bridge 121 and the neck 128. An electromagnetic type of pickup prevents the monitor 118 from being mounted across the entire length of the body 111. Prior art shows that the monitor 118 has been installed at a distance from the electro-magnetic pickups 119 to avoid a situation where the monitor 118 imparts electrical interference in the audio output of the pickups 119. Electro-magnetic pickups also occupy space on the front of the instrument, which physically prevents a large monitor from being mounted in this area.

For at least the abovementioned reasons, previous monitor type instruments have been limited in their design and construction to small screens and noisy electronics. In the field of stringed instruments containing a display monitor, there is no prior art indication of an instrument containing a monitor wherein said monitor is mounted directly beneath the bridge of the instrument. Nor is there allowance for a monitor mounted in a central location and covering a majority of the front of the instrument body.

Thus, a heretofore unaddressed need exists in the industry to address the aforementioned deficiencies and inadequacies.

SUMMARY OF THE INVENTION

Embodiments of the present invention provide a system and method for providing a musical instrument having a monitor therein. A disclosed bridge assembly overcomes limitations of the prior art by allowing for an instrument bridge to be mounted centrally to a large image display monitor, and for the instrument pickups to function without causing electrical interference with the audio output from the instrument.

Briefly described, in architecture, one embodiment of the musical instrument, among others, can be implemented as follows. The instrument contains a musical instrument body having a body cavity therein, and a monitor having a front face and a back, where the monitor fits within the body cavity of the musical instrument body. A screen cover is situated above the front face of the monitor and a cover plate positions the screen cover above the front face of the monitor, where the cover plate covers at least a portion of the screen cover. A bridge is located on a front face of the screen cover, where the bridge contains a pickup that does not use electromagnetic induction, and that senses vibrations of strings, suspended on the bridge, above the monitor, and translates the vibrations into audio signals.

Other systems and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

The present invention overcomes prior limitations in technology by allowing a stringed instrument bridge assembly to be mounted directly above the display screen of a monitor. This invention also allows the monitor to cover the area between the bridge and the neck of the instrument, which is traditionally where electromagnetic pickups are mounted. Therefore, much larger monitors can be displayed on the body of the instrument. In addition, the present invention allows for many new and various positions in which the monitor can be mounted. Furthermore, the proposed electronic instrument does not make use of electromagnetic pickups to output an audio signal. Instead, a piezo-electric type pickup is used, allowing the instrument to function in a similar manner to traditional electronic stringed instruments, but without electrical interference from the monitor. Of course, in replacement of the piezo-electric pickup any pickup that does not use electromagnetic induction may be used.

Figure 2:
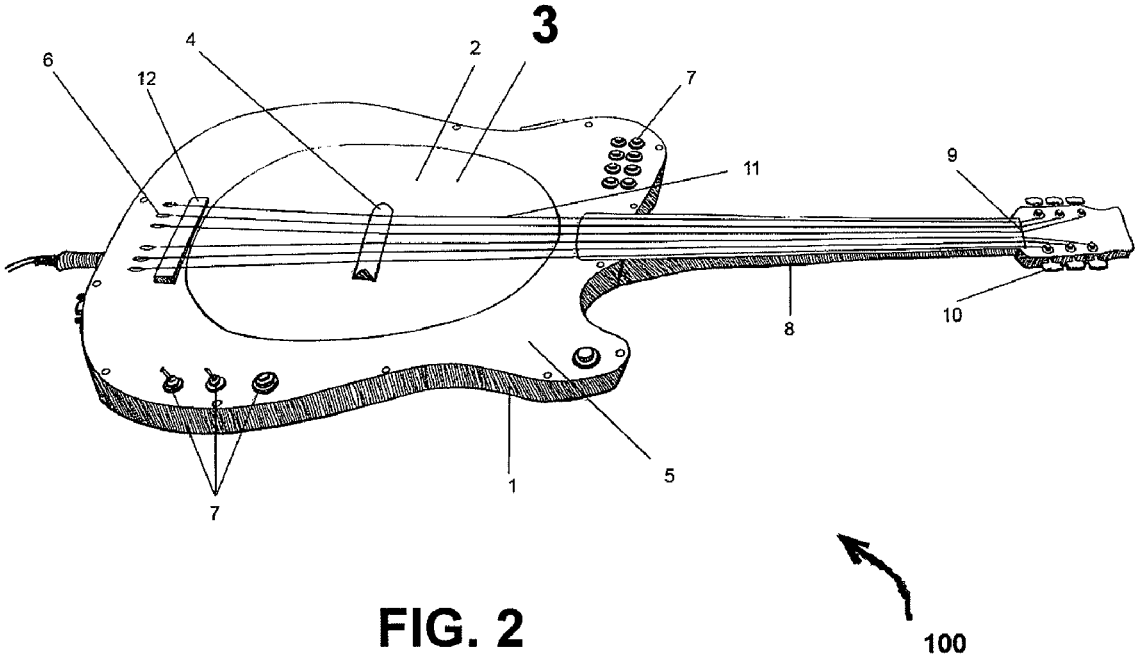
FIG. 2 is a schematic diagram illustrating the present instrument in fully assembled form.

The present invention can be better understood with reference to FIG. 2. FIG. 2 is a schematic diagram illustrating the present instrument 100 in a fully assembled form. This illustration shows a completed bridge assembly mounted to the instrument 100 in its assembled and operational form. A monitor 2 is positioned underneath a bridge 4 and in a central location to the body 1 of the instrument 100. It should be noted that the monitor may be one of many different types of monitors. As an example, the monitor may be a matrix type monitor, such as, but not limited to, a liquid crystal display (LCD) monitor (e.g., CCFL backlight, LED backlight, etc.), an organic light emitting diode (LED) display, or an LED matrix display. It should be noted that these examples of monitors are provided merely for exemplary purposes and are not intended to be a limitation to the different types of monitors that may be used in the present invention.

A clear screen cover 3 is used to support the bridge above the screen cover 3 of the monitor 2. Images displayed on the monitor 2 can be viewed through the clear screen cover 3. Preferably, a body cover plate 5 can be used to hold the monitor 2 and screen cover 3 in place. The body cover plate 5 has a hole cut into the center to allow the image from the monitor 2 to be viewed. In accordance with an alternative embodiment of the invention, the body cover plate 5 can be cut into different shapes to change the viewable portion of the monitor 2 and add various aesthetic designs to the instrument. It should be noted that, while the present description provides for a single monitor, one having ordinary skill in the art would appreciate that more than one monitor may be provided in the body of the instrument The strings 11 of the instrument 100 can be seen anchored to a tailpiece 6 on a rear side of the body 1. The strings 11 pass over the monitor 2 and are suspended by the bridge 4. Preferably, a vibration dampening pad or pads 12 can be used to limit vibrations of the rear portion of the strings 11, between the tailpiece 6 and the bridge 4. After the bridge 4, the vibrating portion of the strings 11 proceed down a neck 8 of the instrument 100 to a nut 9, and then on to tuning machines 10.

Figure 3:
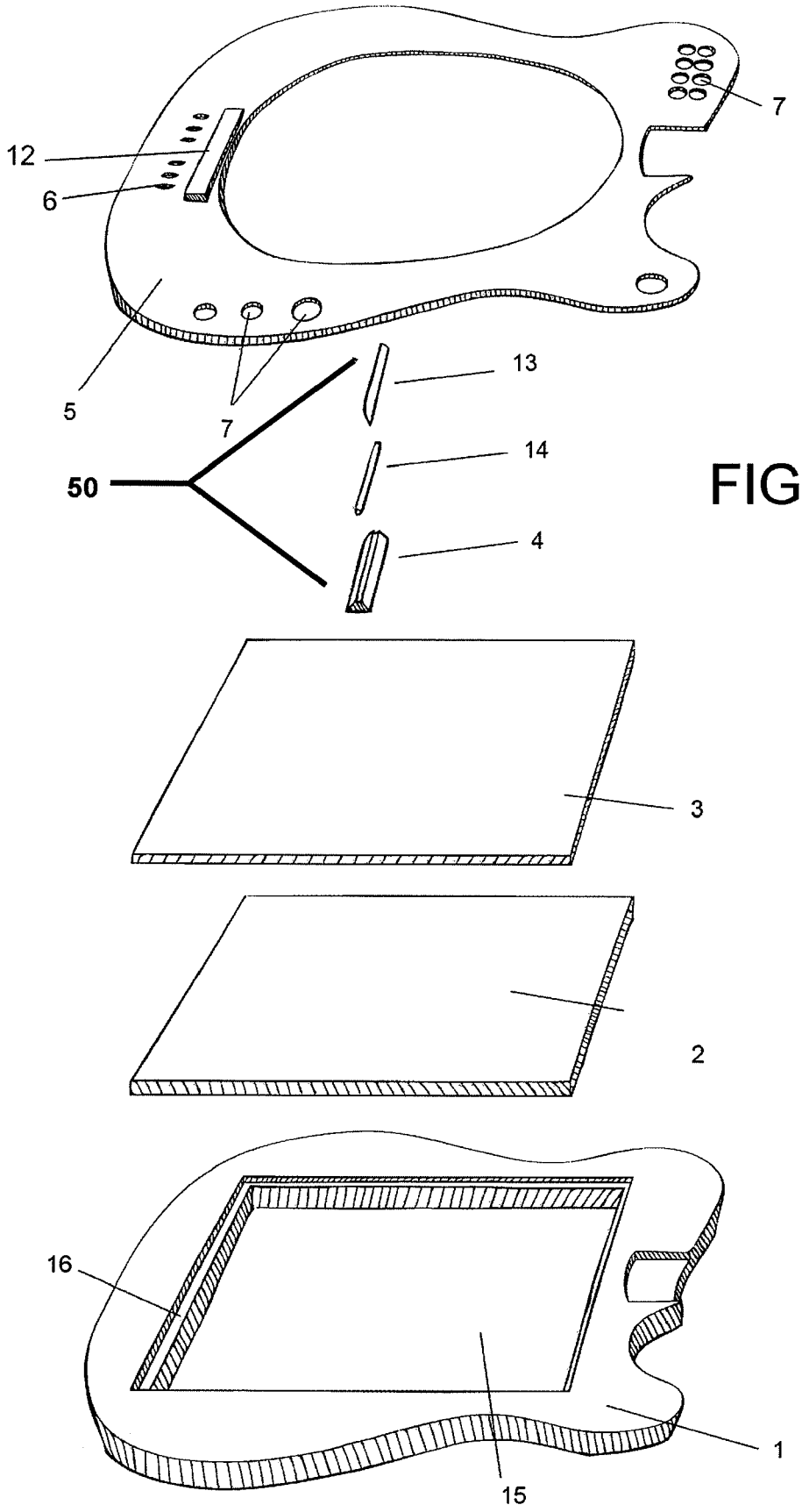
FIG. 3 is a schematic diagram illustrating an expanded, perspective view, of the instrument prior to assembly.

FIG. 3 is a schematic diagram illustrating an expanded, perspective view, of the instrument 100 prior to assembly. FIG. 3 shows portions of a bridge assembly 50 as it is mounted on the instrument 100. This figure is useful in understanding the construction of the bridge assembly 50. The instrument body 1 is first made to have a body cavity 15, inside which the monitor 2 is recessed. A screen cover 3 fits above the monitor 2, and is also contained inside the body cavity 15. Preferably the screen cover 3 is made to fit inside the body cavity 15 in a manner where a front face of the screen cover 3 meets nearly flush with the top of the instrument body 1. This screen cover 3 could be made from glass, plastic, Plexiglas®, or any other similar hard and transparent material. The bridge 4 of the instrument 100, with piezo-electric pickup 14 and saddle 13, is then placed above the monitor 2 and is supported by the screen cover 3.

The bridge 4 can be positioned at any point across the screen cover 3 surface, including a central location above the monitor 2. The connection to the screen cover 3 at the base of the bridge 4 could be reinforced with adhesive or fasteners to ensure that the bridge 4 stays in the proper playing position over the monitor 2. In addition, when constructing the present bridge assembly, a variety of bridge designs may be used. The bridge 4 may be fabricated to look like a traditional acoustic or electric stringed instrument bridge, or it can be made from new materials and using new designs, such as, but not limited to, using a transparent or translucent material to build the bridge 4. Most importantly, the new bridge assembly may contain a piezo-electric pickup 14 to sense string vibrations.

The piezo-electric pickup 14 can be contained within the saddle or made to be in contact with the saddle of the bridge 4. A piezo-electric pickup 14 creates an output signal from the instrument 100 by applying the vibration force of the string to a piezo crystal. Since piezo-type instrument pickups do not use electromagnetic induction, this type of pickup is not subject to the hum interference when it is placed in close proximity to the monitor 2.

One embodiment of the invention allows for the screen cover 3 to fit into a portion of the body cavity 15 that is slightly wider than the portion that contains the monitor 2. This wider portion, referred to herein as the lip 16, can be used to suspend the screen cover 3 slightly above the monitor 2 allowing forces pressing on the screen cover 3 to be transferred to the instrument body 1 and thereby protecting the monitor 2 from those forces. Of course, another means of protecting the monitor 2 from these forces could also be used. For example, if the monitor 2 itself were to be made using a clear and durable screen surface, then the screen cover 3 could be said to be included into the construction of such a monitor 2.

Preferably a body cover plate 5 can be installed directly on top of the screen cover 3 and mounted to the instrument body 1. The body cover plate 5 has a hole cut in the center, which allows one to view the image monitor 2 and screen cover 3 through the body cover plate 5. The body cover plate 5 serves to contain the screen cover 3 and monitor 2 within the instrument body. The body cover plate 5 can also be used to provide aesthetic variations to the instrument 100 by altering the shape of the plate 5 and also that of the hole or holes cut into the body cover plate 5. Additionally, instrument controls 7, such as volume and tone adjustments, as well as many other types of controls, can be mounted to the body cover plate 5.

Figure 1:
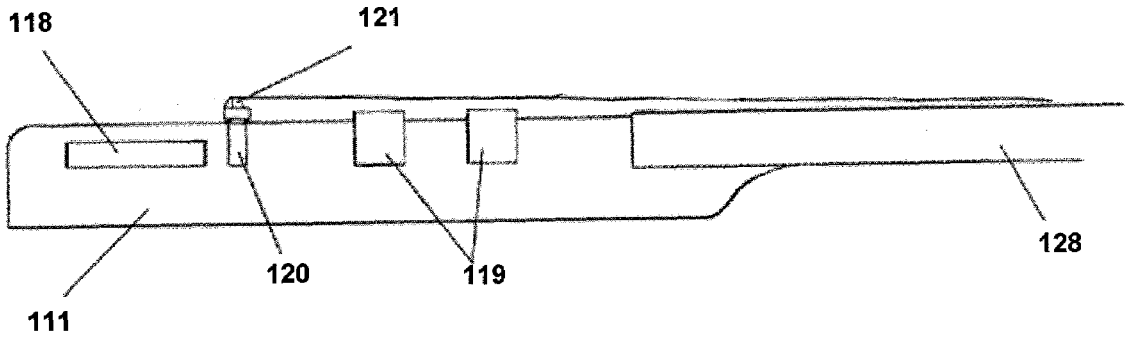
FIG. 1 (PRIOR ART)
FIG. 1 is a schematic diagram illustrating a cross-sectional side view of a prior art stringed instrument containing a monitor.
Figure 4:
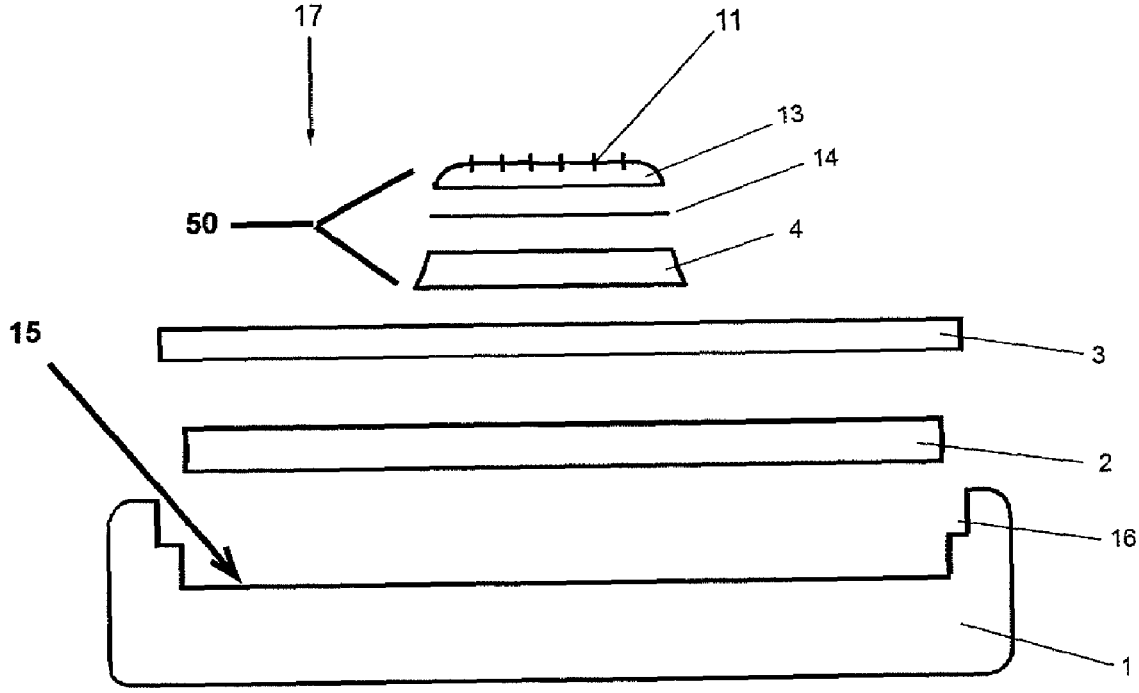
FIG. 4 is a schematic diagram illustrating an expanded, cross-sectional rear view, of the present bridge design showing how the bridge is mounted to a body cavity of the instrument of FIG. 2.

FIG. 4 is a schematic diagram illustrating an expanded, cross-sectional rear view, of the present bridge design showing how the bridge 4 is mounted to a body cavity 15 of the instrument 100 of FIG. 1. FIG. 4 details the bridge assembly 50 in an expanded cross-sectional view from the rear of the instrument 100. Inside the body cavity 15 of the instrument 100, the screen cover 3 is shown positioned above the monitor 2, and held preferably in place by a lip 16 in the instrument body 1, which can support the screen cover 3. The bridge 4 is then made to rest on top of the screen cover 3. The screen cover 3 supports the downward force 17 of the bridge 4, which is caused by tension in the strings 11. The cover 3 also protects the monitor 2 from damage by the player of the instrument 100 and from dirt and debris that comes in contact with the instrument 100 during use.

A bridge saddle 13 holds the strings 11 in playing position. The saddle 13 is located on the top portion of the bridge 4. The saddle 13 may be used to allow string height and intonation to be adjusted. The bridge saddle 13 transfers string vibrations to a piezo-electric pickup 14. The piezo-electric pickup 14 outputs an electrical signal based on the vibrations of the strings 11. Further reference and explanation of the piezo-electric pickup is provided hereinafter.

Figure 5:
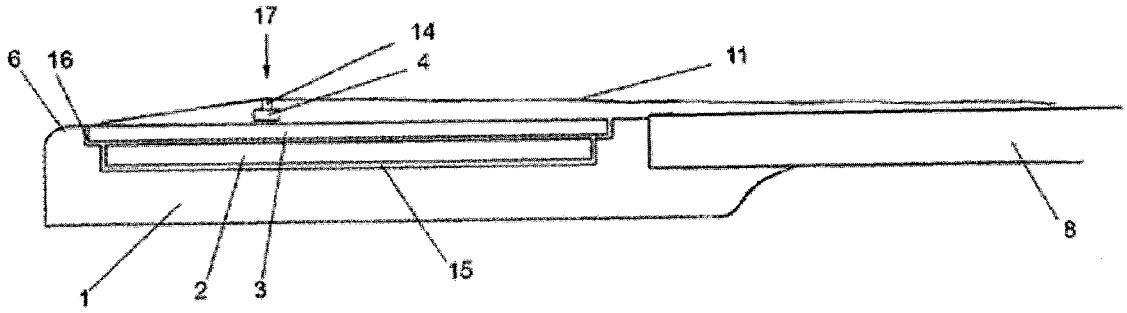
FIG. 5 is a schematic diagram illustrating a cross-sectional side view of the present instrument.

FIG. 5 is a schematic diagram illustrating a cross-sectional side view of the present instrument. FIG. 5 demonstrates the advantages of the present bridge assembly over the prior art instrument (shown in FIG. 1). In this embodiment, the body cavity 15 is clearly shown to extend a majority of the distance from the rear of the instrument 100 near the tailpiece 6, under the bridge 4, and extending toward the neck 8. The monitor 2 and screen cover 3 can be made to occupy the total length of the body cavity 15. It should be noted that the monitor 2 now occupies the space where, according to the prior art of FIG. 1, the mounting posts for the bridge were mounted, and also the space where the electromagnetic pickups 119 (FIG. 1) were mounted. The strings 11, after being mounted at the tailpiece 6, and pulled to tension over the bridge 4, create a downward force 17 on the screen cover 3. The screen cover 3 keeps this force from acting upon and damaging the monitor 2 beneath.

A piezo-electric pickup 14 allows the instrument to output an audio signal, without the interfering "hum" from the monitor 2. The piezo-electric pickup 14 is essential to this bridge assembly because it is a vibration sensitive pickup, which is not subject to the electronic interference created by the monitor 2. The piezo-electric pickup 14 allows the instrument to output an audio signal based on string vibrations, without the use of the electromagnetic pickups 119 shown in the prior art, FIG. 1.

In accordance with an alternative embodiment of the invention, the strings are anchored directly to the bridge itself. In this case, the string anchors at the rear of the instrument body are not used. Instead, a mechanical means of attaching the bridge to the body is used.

Another embodiment of the new bridge assembly allows for a bridge, which contains mechanical adjustment features allowing for the bridge to be raised and lowered to change the height of the strings above the instrument body. This embodiment also allows for the bridge to contain mechanical adjustment features, which allow the string length (intonation) to be adjusted.

Alternatively, the string anchors at the rear of the instrument may be mounted on a mechanical system which allows for the string tension to be altered by the user while playing the instrument. When the string tension is altered, the tuned pitch of the string is altered accordingly.

In addition, the screen cover can be made to contain a touch sensitive sensor that is capable of transmitting data to a computer. This data can be used to interact with programs that control audio devices or images on the screen. Use of this system allows for the player of the instrument to communicate with a computer by touching the screen cover of the bridge assembly.

Another embodiment of the invention allows for the audio signal data, generated by the piezo pickup, to be sent to a computer that is mounted internally or externally to the instrument body. The computer can use this audio data to generate images that are displayed on the monitor screen of the instrument. It should be noted that if the computer is located external to the instrument, the computer may be in communication with the instrument via a wired connection of a wireless connection.

Further embodiments of the bridge assembly relate to the various types of stringed instrument pickups. As an example, a magnetic pickup, which is attached directly to the bridge of a stringed musical instrument, may be used. In addition, a miniature version of an electromagnetic pickup may be mounted alongside an instrument bridge. In this case electrical interference generated by the monitor may be filtered out of the audio path with appropriate grounded metal shielding and/or the use of analog and digital filters.

Another type of pickup that could be used is a photo-optical type of pickup. While this pickup is much more complicated and costly than a piezo-electric pickup, one embodiment of the invention provides for the use of a photo-optical pickup to be used in place of a piezo pickup in a bridge assembly for a monitor type instrument.

In accordance with an alternative embodiment of the invention, the instrument may also contain a vibrato, also referred to as a tremolo, device for varying the pitch of the instrument.

It should be emphasized that the above-described embodiments of the present invention are merely possible examples of implementations, merely set forth for a clear understanding of the principles of the invention. Many variations and modifications may be made to the above-described embodiments of the invention without departing substantially from the spirit and principles of the invention. All such modifications and variations are intended to be included herein within the scope of this disclosure and the present invention and protected by the following claims.

I claim:

1. A musical instrument, comprising:

a musical instrument body having a body cavity therein;

a monitor having a front face and a back, wherein said monitor fits within said body cavity of said musical instrument body;

a screen cover situated above said front face of said monitor;

a cover plate positioning said screen cover above said front face of said monitor, wherein said cover plate covers at least a portion of said screen cover; and a bridge located on a front face of said screen cover, wherein said bridge comprises a pickup that senses vibrations of strings, suspended on said bridge, above said monitor, and translates said vibrations into audio signals.

2. The musical instrument of claim 1, wherein said screen cover is comprised of a hard clear material.

3. The musical instrument of claim 1, wherein said signals are analog audio signals.

4. The musical instrument of claim 1, wherein said bridge is transparent.

5. The musical instrument of claim 1, wherein said monitor is a liquid crystal display (LCD) type of monitor.

6. The musical instrument of claim 1, wherein said monitor is a light emitting diode (LED) matrix type of monitor.

7. The musical instrument of claim 1, wherein there are a plurality of said monitors fitting within said body cavity of said musical instrument body.

8. The musical instrument of claim 1, wherein said pickup is a photo-optical pickup.

9. The musical instrument of claim 1, wherein said audio is transmitted from said pickup to a computer for processing and used to generate and interact with images displayed on said monitor.

10. The musical instrument of claim 9, wherein said computer is located within said musical instrument.

11. The musical instrument of claim 9, wherein said computer is located external to said musical instrument.

12. The musical instrument of claim 1, further comprising a vibrato device for varying pitch of said musical instrument.

13. The musical instrument of claim 1, wherein said pickup is a piezo-electric pickup.

14. A musical instrument, comprising:

a musical instrument body having a body cavity therein;

a monitor having a front face and a back, wherein said monitor fits within said body cavity of said musical instrument body;

a cover plate; and a bridge located on said front face of said monitor, wherein said bridge comprises a pickup that senses vibrations of strings, suspended on said bridge, above said monitor, and translates said vibrations into audio signals.

15. The musical instrument of claim 14, wherein said signals are analog audio signals.

16. The musical instrument of claim 14, wherein said bridge is transparent.

17. The musical instrument of claim 14, wherein said monitor is a liquid crystal display (LCD) type of monitor.

18. The musical instrument of claim 14, wherein said monitor is a light emitting diode (LED) matrix type of monitor.

19. The musical instrument of claim 14, wherein there are a plurality of said monitors fitting within said body cavity of said musical instrument body.

20. The musical instrument of claim 14, wherein said pickup is a photo-optical pickup.

21. The musical instrument of claim 14, wherein said audio is transmitted from said pickup to a computer for processing and used to generate and interact with images displayed on said monitor.

22. The musical instrument of claim 21, wherein said computer is located within said musical instrument.

23. The musical instrument of claim 21, wherein said computer is located external to said musical instrument.

24. The musical instrument of claim 14, further comprising a vibrato device for varying pitch of said musical instrument.

25. A musical instrument, comprising:

a musical instrument body having a body cavity therein;

a monitor having a front face and a back, wherein said monitor fits within said body cavity of said musical instrument body; and a bridge located on said front face of said monitor, wherein said bridge comprises a pickup that senses vibrations of strings, suspended on said bridge, above said monitor, and translates said vibrations into audio signals.

* * * * *